United States Patent [19]

Pillifant, Jr.

[11] 4,383,782

[45] * May 17, 1983

[54] TRAFFIC BARRICADE

[75] Inventor: Harold E. Pillifant, Jr., 3522 W. Dunlap, #214, Phoenix, Ariz. 85021

[73] Assignee: Harold E. Pillifant, Jr., Pheonix, Ariz.

[ * ] Notice: The portion of the term of this patent subsequent to Mar. 3, 1998, has been disclaimed.

[21] Appl. No.: 162,123

[22] Filed: Jun. 23, 1980

Related U.S. Application Data

[63] Continuation-in-part of Ser. No. 80,470, Oct. 1, 1979, Pat. No. 4,253,777.

[51] Int. Cl.[3] ..... E01F 13/00

[52] U.S. Cl. ..... 404/6; 256/64; 248/150; 40/604

[58] Field of Search ..... 404/6; 256/64, 13.1; 248/150; 116/63 R, 63 P; 40/584, 604, 606, 612, 124.1; 52/71

[56] References Cited

U.S. PATENT DOCUMENTS

| | | | |
|---|---|---|---|
| 3,065,680 | 11/1962 | Wiedman | 188/32 |
| 3,139,255 | 6/1964 | Palm | 248/150 |
| 3,532,310 | 10/1970 | Finfrock | 248/150 X |
| 3,690,620 | 9/1972 | Matson et al. | 256/64 |
| 3,802,667 | 4/1974 | Kanan | 404/6 |
| 3,817,482 | 6/1974 | Molina | 248/150 X |
| 4,104,980 | 8/1978 | Toomey | 256/64 X |
| 4,253,777 | 3/1981 | Pillifant | 404/6 |
| 4,298,186 | 11/1981 | Glass | 404/6 |

*Primary Examiner*—Ernest R. Purser

*Attorney, Agent, or Firm*—Cahill, Sutton & Thomas

[57] ABSTRACT

A traffic barricade is constructed from a foldable material such as cardboard impregnated with a waterproofing material or double-faced corrugated plastic or cardboard impregnated with a waterprooofing material. First and second flat sheet portions of such material are provided, each having a pair of scorelines, the first of which defines a border of a vertical area and the second of which forms a border of a horizontal area when the barricade is erected. The flat sheet portions each have a sloping surface between the scorelines when the barricade is erected. The vertical areas of the two flat sheet portions are permanently secured to each other.

In one embodiment, a warning light is incorporated within the traffic barricade by forming holes in the vertical areas and attaching plastic lenses over each of the holes.

In another embodiment, the first and second flat sheet portions are formed from a single flat sheet whereby either the vertical areas of the first and second sheet portions are joined along a fold line or else the horizontal areas bordered by the second scorelines form a single, continuous horizontal area.

24 Claims, 19 Drawing Figures

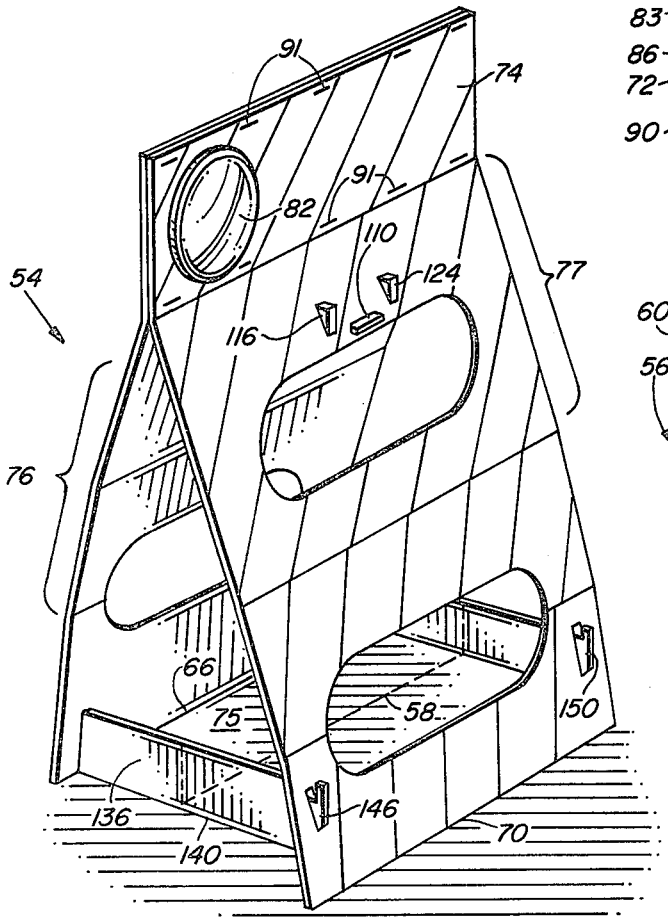
FIG. 11
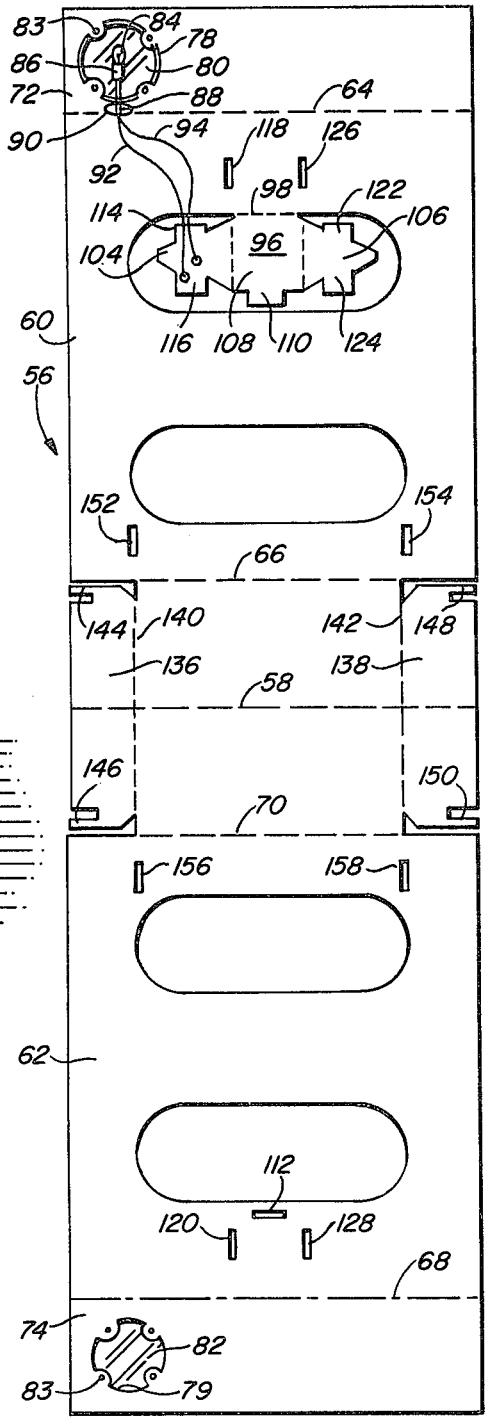
FIG. 12
FIG. 13
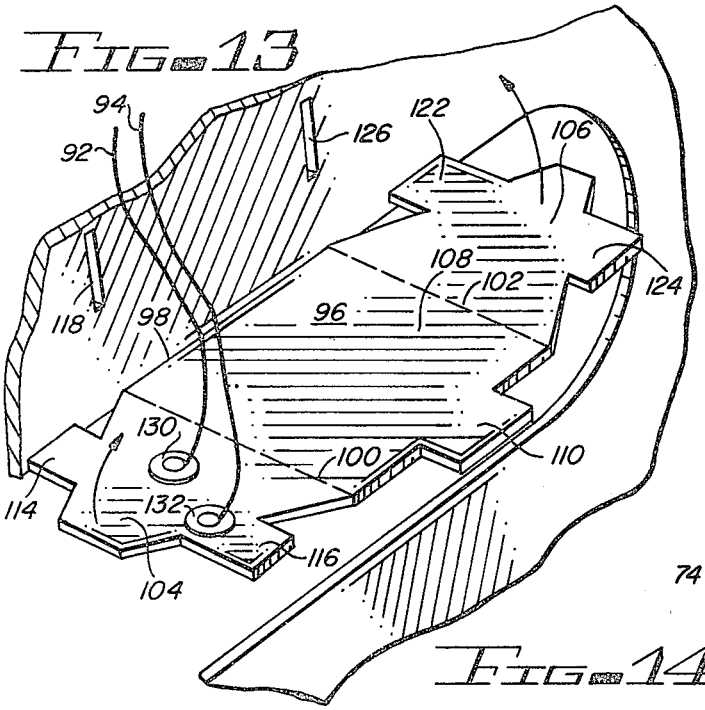
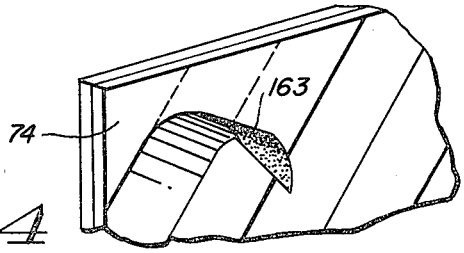
FIG. 14

TRAFFIC BARRICADE

REFERENCE TO RELATED APPLICATION

The present patent application is a continuation-in-part of co-pending patent application, Ser. No. 80,470, filed Oct. 1, 1979 by Harold E. Pillifant, Jr., and entitled "DISPOSABLE TRAFFIC BARRICADE" now U.S. Pat. No. 4,253,777.

BACKGROUND OF THE INVENTION

1. Field of the Invention

The present invention relates to traffic barricades, and more particularly, to traffic barricades of the type that are used to warn motorists and pedestrians of hazardous conditions.

2. Description of the Prior Art

Traffic barricades are well known objects in and around highways and construction sites. Such barricades are typically made of wood crossbars and for metal legs and are in the form of an A-frame that may be folded to be transported on the back of a truck. The A-frames are generally formed in such a manner that they present a slanting area containing a reflective paint such that oncoming motorists can easily see the barricade by the reflected light off of the barricade from their headlights. Barricades positioned along roadways are frequently struck by automobiles or otherwise damaged in handling in transit. Suchbarricades are usually fairly expensive and are used in great quantities. The destruction of the barricades represents a non-recoverable expense that can amount to substantial sums when significant construction, and therefore substantial demand, is undertaken.

Attempting to cheapen the construction of such barricades usually renders the barricades either unreliable or incapable of performing their primary warning function. An additional expense encountered in the usage of prior art barricades is represented by the cost of erecting and disassembling, together with transporting, the barricades to and from the job site. For example, it is quite common for several hundred barricades to be placed along a roadway wherein construction is being undertaken, and wherein several truck loads of the barricades must be transported to the site and meticulously placed in position by the workers only to have to be retrieved by the same workmen when the job is complete. The bulk occupied by such prior art barricades requires substantial storage area and thus either several trips by a single pickup truck or several pickup trucks to gather the barricades.

The Federal Highway Administration has developed regulations regarding devices used on federal highways to control traffic, and such regulations are generally followed by state, county, and city government traffic engineers. A recent 1978 regulation promulgated by the Federal Highway Administration states that no barricades shall be made from any material that would cause damage to any object striking it. In collisions between vehicles and barricades of the metal and wooden type, damage often results to the colliding vehicle, and litigation involving such damage is widespread. Furthermore, barricades having a relatively high center of gravity can be propelled into the air through such collisions and strike workmen or other vehicles.

Other traffic barricades are provided with flashing warning lights for increasing their visibility after dark. Typically, such warning lights are separated constructed, relatively heavy units secured to the upper portion of the wooden and metal barricades. Such lighting units have been known to cause severe property damage and personal injury when struck by a vehicle or another object.

Traffic barricades having a base portion for being weighted by dirt or other ballast material are known in the art. For example, U.S. Pat. Nos. 3,690,620 and 4,104,980 disclose barricades having surfaces which can be weighted with ballast material. However, such prior art barricades will not prevent dirt or other loose ballast material from shifting or falling out of the barricade in strong winds or heavy rains; eventually, such barricades will no longer be properly anchored and will tip over. Furthermore, when such barricades are used in conjunction with freshly prepared road surfaces (new black top, newly painted road markings, etc.), dirt shifting off of the ballasting surface of the barricade can ruin the adjacent freshly prepared surface.

It is therefore an object of the present invention to provide a traffic barricade that can be stored in a flat, thin form to occupy very little space and thus significantly reduce the transportation and storage space required.

It is another object of the present invention to provide a traffic barricade that can be manufactured very cheaply and wherein the expense of the barricade is small enough to permit the barricade to be disposed of after use.

It is still another object of the present invention to provide a traffic barricade that can be manufactured inexpensively while being sufficiently strong and weather resistant to be reuseable for as long as or longer than barricades currently in use.

It is yet another object of the present invention to provide a traffic barricade that is readily assembleable while nevertheless providing a sturdy structure that can be discarded when the requirement for a barricade ends.

It is a further object of the present invention to provide a traffic barricade that can cheaply yet ruggedly be constructed so that the barricade may either be disposed of after useage or may easily be disassembled for reuse.

It is a still further object of the present invention to provide a traffic barricade which can be manufactured inexpensively while complying with all current Federal Highway Administration guidelines and substantially reducing the possibilities of damage to a vehicle or other object striking the barricade.

It is yet a further object of the present invention to provide a traffic barricade having a warning light constructed as to cause no damage to any object striking the barricade.

It is another object of the present invention to provide a traffic barricade which can be anchored with dirt or other loose ballast material while preventing the dirt or loose ballast material from shifting or falling off of the barricade.

These and other advantages of the present invention will become apparent to those skilled in the art as the description thereof proceeds.

SUMMARY OF THE INVENTION

Briefly, and in accordance with one embodiment thereof, the present invention relates to a traffic barricade which includes first and second flat sheet portions of foldable material, each having a first scoreline for folding in a first direction and a second scoreline for folding in a second direction. When the barricade is erected, the first scoreline of each sheet portion on a vertical area thereof and the second scoreline of each sheet portion borders a horizontal area thereof. Each of the first and second sheet portions has a sloping surface between the first and second scorelines when the barricade is erected. A front side of each of the vertical areas has warning indicia applied thereto. The vertical areas of the two sheet portions are permanently secured in back-to-back contact with each other with the warning indicia thereon facing in opposite directions. The horizontal areas of the first and second sheet portions are so assembled to maintain the second scorelines of the two sheet portions in a predetermined spaced apart relationship when the barricade is erected.

One embodiment of the present invention includes a warning light wherein holes are formed in the vertical areas of the two sheet portions, and a lens is secured to the front side of each of the vertical areas over the holes therein. A light source is disposed between the lenses for simultaneously directing light through each of the lenses. A flap formed within the sloping surface of the first sheet portion is scored for folding the flap to form a tray for supporting a battery to power the light source. The flap includes a first scoreline for folding the flap to from a horizontal area; the flap also includes second and third scorelines for folding the flap to form a pair of vertical areas. Electrical contacts are secured to one of the vertical areas for connecting the electrical terminals of the battery, and wires couple the electrical contacts to the light source disposed between the lenses.

In another embodiment of the present invention, the traffic barricade includes a boxed base or tray for containing dirt or other ballast material to anchor the barricade in place. One of the horizontal areas of the first and second sheet portions is provided with edge adjacent areas that are foldable to an upright position to form a tray having a horizontal area on the bottom, having the sloping surfaces of the first and second sheet portions on each end, and having the edge adjacent areas folded to an upright position on the sides. Each of the edge adjacent areas includes outwardly projecting tabs for engaging vertically disposed slots in the sloping surfaces of the first and second sheet portions to maintain the edge adjacent areas in an upright position.

The first and second sheet portions may be formed from a single flat sheet of foldable material. In one embodiment, the single sheet is folded along a line parallel to and equidistant from the first scorelines of the first and second sheet portions. In this embodiment, the first horizontal area having the edge adjacent areas used to form the boxed base extends between and in contact with the sloping surfaces of the first and second sheet portions to maintain the second scorelines in predetermined spaced apart relationship. The second horizontal area includes locking tabs for engaging slots within the edge adjacent areas of the first horizontal area. In another embodiment, the horizontal areas bordered by the second scorelines of the first and second sheet portions form a single continuous horizontal area which joins the first and second sheet portions together.

BRIEF DESCRIPTION OF THE DRAWINGS

The present invention may be more readily described with reference to the accompanying drawings, in which:

FIG. 11 is a perspective view of a traffic barricade which incorporates a warning light and a battery tray for housing a battery to power the warning light.

FIG. 12 is a top view of a flat sheet of foldable material formed so that it may be folded into the barricade of FIG. 11.

FIG. 13 is an enlarged partial perspective view of a flap formed so that is may be folded to form a battery tray.

FIG. 14 is a perspective view illustrating the application of reflective adhesive-backed strips to the barricade of FIG. 11.

DESCRIPTION OF THE PREFERRED EMBODIMENTS

Figure 3:
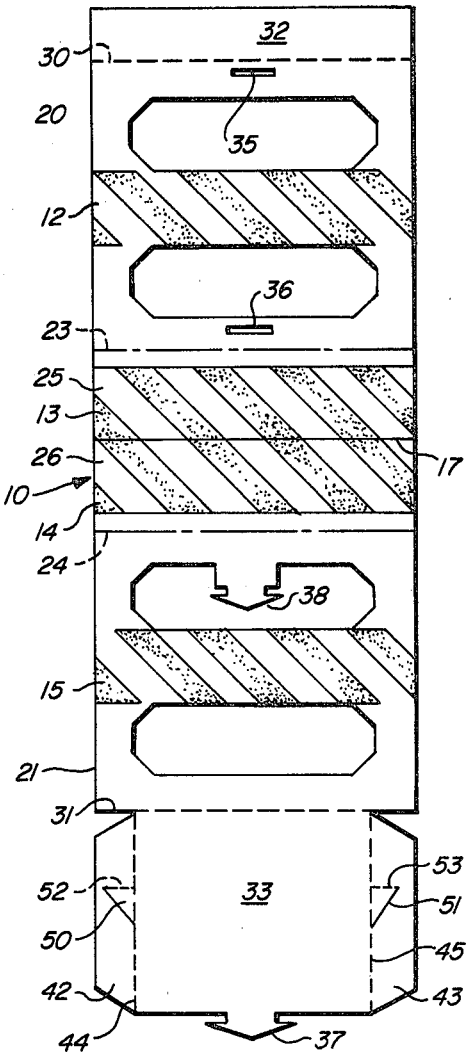
FIG. 3 is a top view of a flat sheet of foldable material formed so that it may be folded into the barricade of FIG. 1.

Referring now to the drawings, a flat sheet of foldable material 10, such as that shown in FIG. 3, is formed from an inexpensive semi-rigid material. Preferably, double-faced corrugated plastic material is used as it exhibits extreme bursting and tear strength, is impervious to all weather conditions and can treated for resistance to ultraviolet radiation from intense sunlight. This plastic material can be corona treated so that it may be printed, and can be easily die-cut and folded. However, other foldable materials may be used; for example, heavyweight corrugated cardboard has been found to operate satisfactorily and can be waterproofed through the use of a wax or plastic coating in a well known manner.

The flat sheet 10 may be cut from a single sheet as shown in FIG. 3 and appropriately scored or stamped using readily available sheet material handling machinery without the requirement for special tools or tooling. Further, when the barricade of the present invention is formed from such single sheets or flat material, they can be readily coated with reflective material, such as that shown at 12, 13, 14 and 15, using conventional techniques. Normally, the types of reflective materials or paints that are used, as well as the total area of the reflective material is dictated by highway department regulations or federal highway department rules that specify numerous criteria for such traffic barricades. The sheet of material 10 may be packaged and transported in the form shown in FIG. 3; alternatively, the sheet may be folded along fold line 17 to form a double thickness. Normally, it will be found to be more advantageous to fold the material along the fold line 17 and permanently secure the two flat sheet portions thus formed by the folding by stapling, such as that shown at 18 in FIG. 1 or by glueing. The reasons for such stapling or glueing will become apparent as the description proceeds.

Rather than form the barricade of the present invention out of a single sheet as shown in FIG. 3, two separate sheet portions may be cut and attached by staples, as described above after the folding of the single sheet. After the single sheet has been folded, or if two separate sheet portions are used, two flat sheet portions of foldable material are provided such as shown at 20 and 21. Each of these flat sheet portions of foldable material have a first scoreline 23 and 24, respectively, each of which, when folded, forms a vertical area 25 and 26, respectively. As mentioned previously, these vertical areas are permanently secured to the corresponding area of the other sheet portion of foldable material in back-to-back fashion with the reflective material thereon facing opposite directions.

The flat sheets of foldable material 20 and 21 also include second scorelines 30 and 31, respectively. The second scorelines form a border of corresponding horizontal areas 32 and 33, respectively, when the barricade is erected. It may be noted that the scorelines 23 and 24 are such that the material is folded in a first direction while the scorelines 30 and 31 are such that the material is scored in the opposite direction. Therefore, scorelines 30 and 31 are represented in FIG. 3 by dashed lines while scorelines 23 and 24 are represented by dashed dot lines. The sheet portion 20 is provided with slots 35 and 36 to receive locking tabs 37 and 38, respectively.

Figure 1:
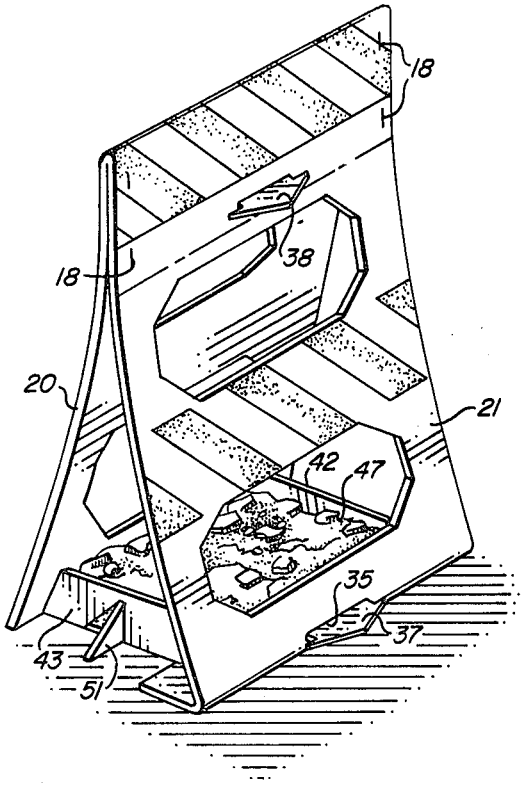
FIG. 1 is a perspective view of a traffic barricade constructed in accordance with the teachings of the present invention.
Figure 2:
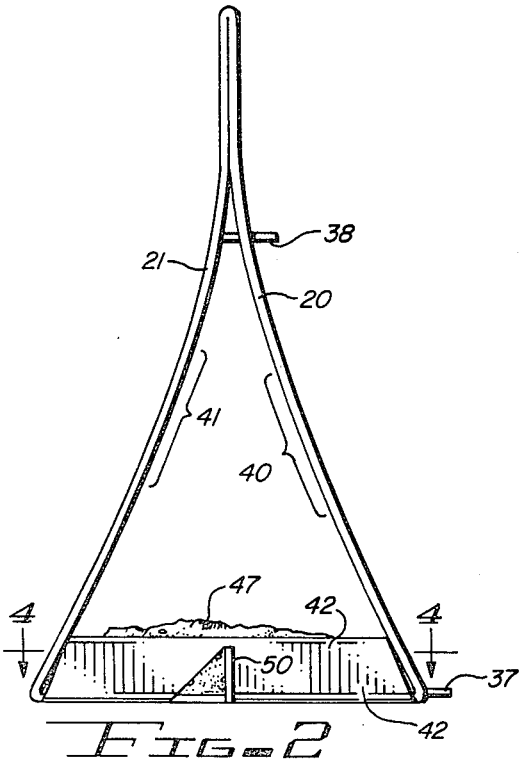
FIG. 2 is a side elevational view of the barricade of FIG. 1.
Figure 4:
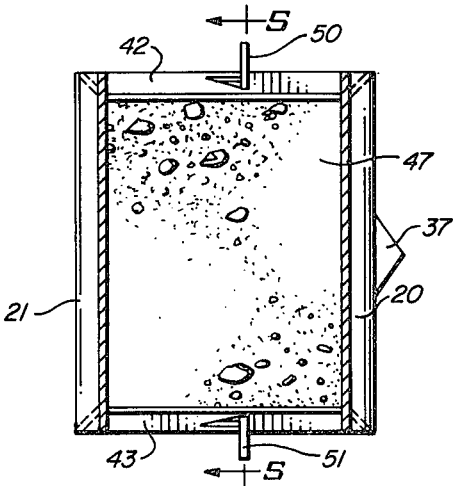
FIG. 4 is a cross-sectional view of FIG. 2 taken along line 4—4.
Figure 5:
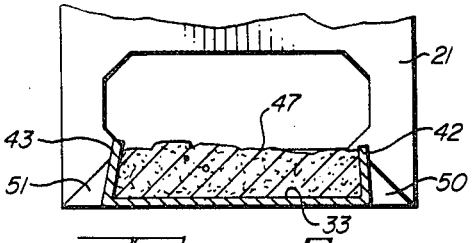
FIG. 5 is a cross-sectional view of FIG. 4 taken along line 5—5.
Figure 6:
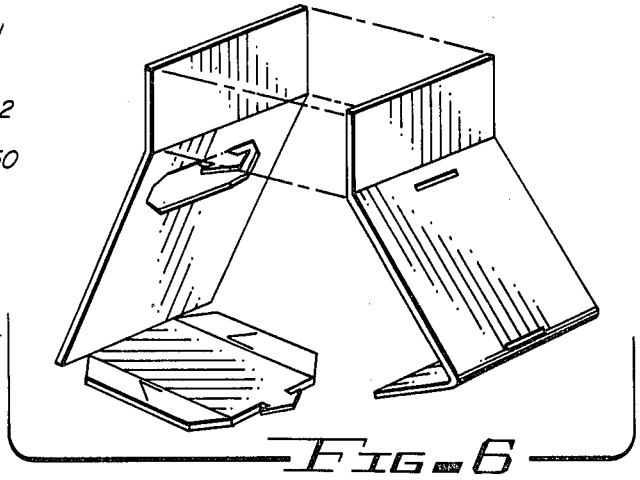
FIG. 6 is an exploded perspective view of a second embodiment of the present invention showing the utilization of two separate sheet portions of foldable material in lieu of the single sheet of foldable material of FIG. 3.

When the barricade is erected as shown in FIGS. 1 and 2, the horozontal areas 32 and 33 extend toward one another and overlap; since the horizontal area 33 is larger than the area 32, it extends between and is in contact with the sloping surfaces 40 and 41 of the sheet portions 20 and 21, respectively. By extending between the flat sheet portions, the horizontal area 33 maintains the second scorelines 30 and 31 in a predetermined spaced apart relation. The horizontal area 30 includes a pair of edge adjacent areas 42 and 43 that are foldable along scorelines 44 and 45, respectively, into an upright position. When in the upright position, a tray is formed (best shown in FIGS. 4 and 5) having the horizontal area 33 on the bottom, having the sloping surfaces 40 and 41 of the flat sheet portions on each end, and having the edge adjacent areas 42 and 43 folded to an upright position on the sides. The tray thus formed provides a receptacle for receiving dirt 47 or other ballast materials to anchor the barricade in place and permit it to withstand winds or other forces that would tend to dislodge the barricade from its designated position. It may be noted that the resulting anchored barricade has a very low center of gravity, thus presenting substantial stability and resistance to tipping.

The edge adjacent areas 42 and 43 include fold-out tabs 50 and 51 that are pivoted about substantially vertical scorelines 52 and 53, respectively, so that when the tabs are folded out, they extend in a substantially vertical plane and support the edge adjacent areas 42 and 43 in upright positions. Thus, when the tray formed by the edge adjacent areas, the sloping surfaces of the flat sheet portions, and the area 33 is filled with dirt, the upright edge adjacent areas 42 and 43 will be maintained in their respective upright positions against the force exerted by the dirt within the tray.

To facilitate "locking" of the sheet portions together and to supplement the attachment of the two sheet portions together, the locking tabs 37 and 38 may be inserted into their corresponding slots 35 and 36, as shown.

Figure 7:
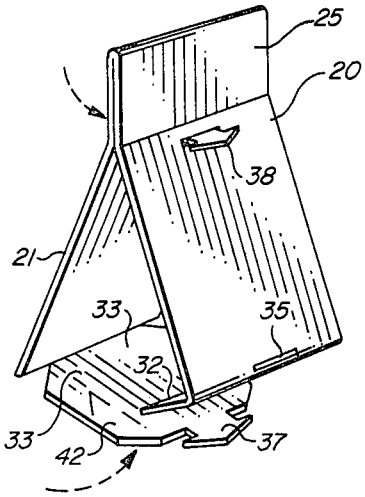
FIG. 7 is a perspective view of the foldable material of FIG. 3 shown in partially folded condition.
Figure 9:
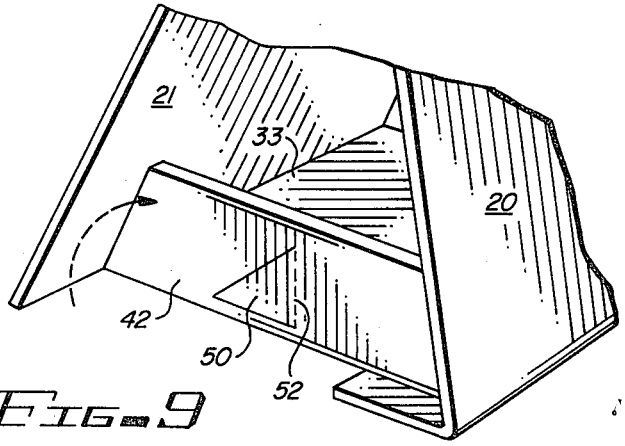
FIG. 9 is an enlarged perspective view of the bottom portion of the folded sheet of FIG. 3 showing an enlarged edge adjacent area in its folded position.
Figure 8:
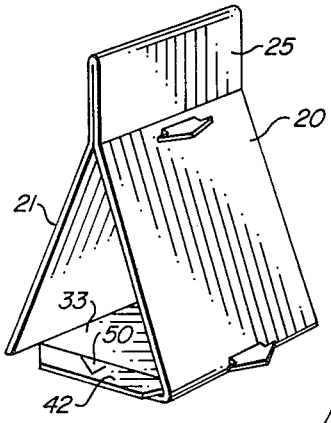
FIG. 8 is another perspective view of the foldable sheet of FIG. 3 shown in partially folded condition.
Figure 10:
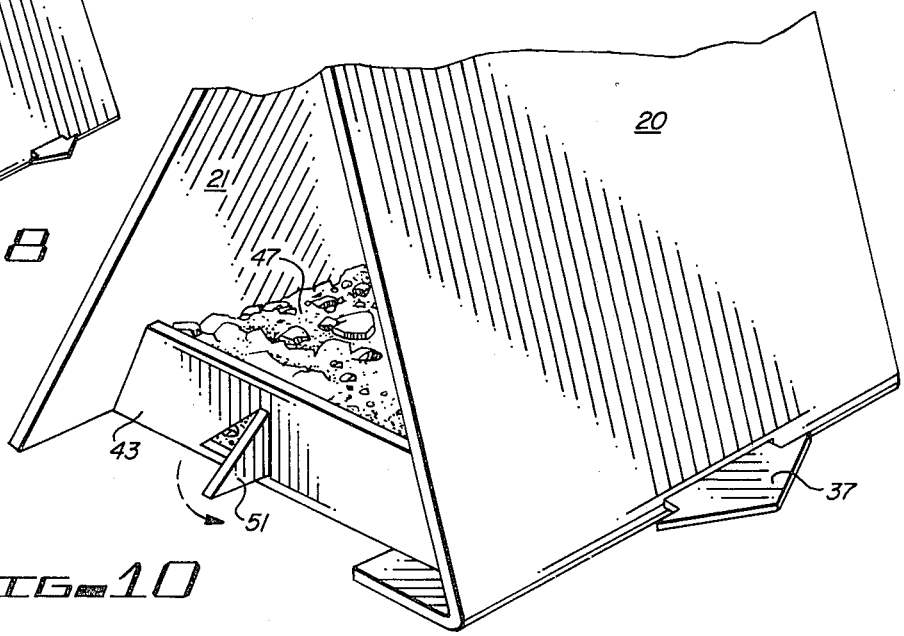
FIG. 10 is a view similar to FIG. 9 showing tabs in a folded-out position to support the upright position of the foldable edges of FIG. 9.

In use, the barricades of the present invention will normally be shipped, stacked and delivered to the job site with sheet 10 already folded along fold lines 17 to form two flat sheet portions of material abutting each other. In this manner, the double thickness, double flat sheet structure is very compact and requires very little room in comparison to an equivalent number of prior art barricades. Upon reaching the job site, the barricade is folded, as shown in FIG. 7, with the locking tab 38 inserted into the slot 36. The area 33 is folded along the scoreline 31 and the locking tab 37 is inserted in the slot 35, as shown in FIG. 8. The edge adjacent areas 42 and 43 are then folded along the respective scorelines 44 and 45 to an upright position, as shown in FIG. 9. The respective tabs 52 and 53 are then pivoted outwardly to assume a vertical supporting position, such as shown in FIG. 10. In this manner, the otherwise flat and compact double thickness sheet of foldable material is formed into a barricade such as shown in FIG. 1 with a tray provided at the bottom thereof for receiving dirt or other ballast material to maintain the barricade in place. The barricade may be manufactured by conventional cardboard and box manufacturing techniques with the appropriate reflective markings printed or painted thereon in inexpensive mass production machinery. When corrugated cardboard material is used to construct the barricade, it may be resin impregnated, wax coated or coated with a water repellent resistant plastic material to permit the barricade to withstand rain and moisture. The inexpensive nature of the barricade permits the barricade simply to be disposed of when the job is completed. However, materials such as double-faced corrugated plastic can absorb tremendous amounts of abuse and can withstand adverse weather conditions; thus, the use of such materials to form the barricade according to the teachings of the present invention will allow such barricades to have a lifetime comparable to or exceeding that of conventional wooden and metal barricades. In the event the barricades are to be retrieved, they may simply be disassembled by reversing the steps described previously in connection with their assembly. The resulting retrieved barricade is again a flat, double thickness sheet of material that can be stacked and can be carried in a very small space. Literally hundreds of barricades constructed in accordance with the teachings of the present invention may be carried in the same space that only a few dozen prior art barricades could be carried.

In FIG. 11, another embodiment of the present invention is illustrated wherein a warning light and battery tray are incorporated within a traffic barricade. The barricade, designated generally 54 in FIG. 11, may be constructed from a single flat sheet of foldable material 56 as illustrated in FIG. 12. As mentioned above, the foldable material may be double-faced corrugated plastic, weather-proofed cardboard, or any other semi-rigid foldable material. A centrally located scoreline 58 generally divides the single flat sheet of foldable material into a first flat sheet portion 60 and a second flat sheet portion 62. First sheet portion 60 includes a first scoreline 64 and a second scoreline 66. Similarly, second sheet portion 62 includes a first scoreline 68 and a second scoreline 70. It may be noted that the first scorelines 64 and 68 are such that the material is folded in a first direction while the second scorelines 66 and 70 are such that the material is scored in the opposite direction. Therefore, second scorelines 66 and 70 are represented in FIG. 12 by dashed lines while first scorelines 64 and 68 are represented by dashed dot lines.

First scorelines 64 and 68 border vertical areas 72 and 74 of first sheet portion 60 and second sheet portion 62, respectively, when the barricade is erected. As will be explained further below, vertical areas 72 and 74 are permanently secured in back-to-back contact with each other as by stapling when the barricade is constructed. Second scorelines 66 and 70 each border a horizontal area 75 which contacts the ground when the barricade is erected. The area between second scorelines 66 and 70 forms a single, continuous horizontal area 75 which maintains the second scorelines 66 and 70 in predetermined spaced apart relation when the barricade is erected. The area of first sheet portion 60 between first scoreline 64 and second scoreline 66 forms a sloping surface 76. Similarly, the area of second sheet portion 62 between first scoreline 68 and second scoreline 70 forms a sloping surface 77.

Figure 15:
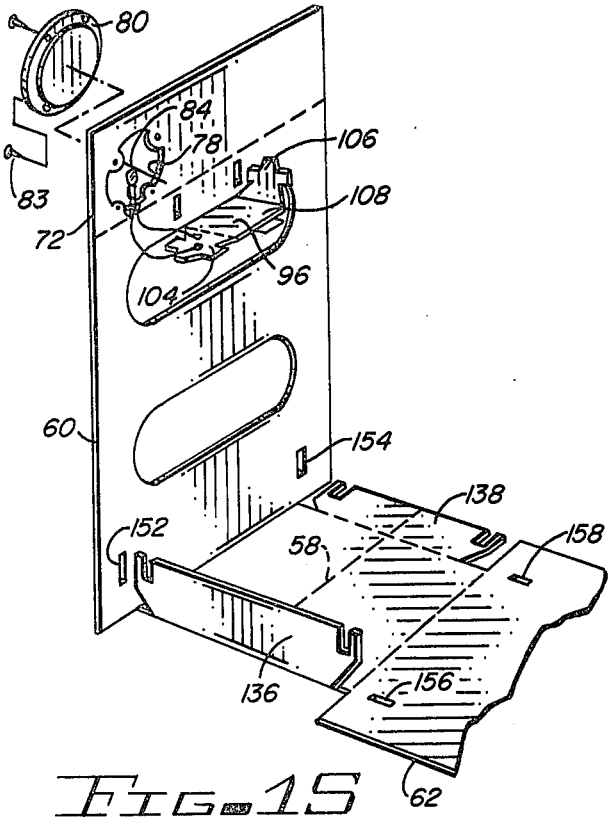
FIG. 15 is a perspective view of the foldable material of FIG. 12 shown in a partially folded condition.

In order to incorporate a warning light within the traffic barricade of FIG. 11, holes 78 and 79 are formed within vertical areas 72 and 74 of the first and second sheet portions, respectively, as shown in FIGS. 12 and 15. Amber colored, unbreakable plastic lenses 80 and 82 are attached to the front sides of vertical areas 72 and 74, respectively. Plastic lenses 80 and 82 are slightly larger than holes 78 and 79 and are centrally disposed over each of the respective holes. Fasteners, such as those designated 83 in FIGS. 12 and 15, may be used to individually attach lenses 80 and 82 to the vertical areas 72 and 74, respectively, prior to permanently securing vertical areas 72 and 74 to each other; alternatively, lenses 80 and 82 can be installed after vertical areas 72 and 74 have been permanently secured, in which case a male threaded fastener inserted through a hole in the rim of lens 80 can engage a female threaded fastener inserted through a corresponding hole in the rim of lens 82 to clamp the lenses toward each other.

In order to direct light through lenses 80 and 82, a light bulb 84 held by a socket 86 is centrally positioned in relation to plastic lens 80, as shown in FIG. 12. Socket 86 is in turn supported by a thin, flat wire guide 88 attached to vertical area 72 by adhesive material 90. Wires 92 and 94 are routed by wire guide 88 to socket 86 for making electrical contact therewith. The opposite ends of wires 92 and 94 make electrical contact with a conventional 6 volt lantern battery housed inside the barricade as described below. When the foldable material illustrated by FIG. 12 is erected to form the barricade, vertical area 72 will be fastened in back-to-back contact with vertical area 74 as by staples 91, for aligning holes 78 and 79 with each other. When so aligned, light emitted from light bulb 84 is simultaneously directed through both lenses 80 and 82.

Preferably, socket 86 incorporates a photo-electric sensor which allows light bulb 84 to be activated only after dark. In addition, a mechanism for causing light bulb 84 to flash when activated may be incorporated either into light bulb 84 itself, or within socket 86.

The components which form the warning light are relatively inexpensive, and incorporation of the warning light within the barricade does not significantly increase its cost. As the warning light is lightweight and totally incorporated within the barricade itself, the likelihood that a vehicle or other object striking the barricade will be damaged is extremely low.

In addition to incorporating the warning light within the vertical areas of the first and second sheet portions, the traffic barricade illustrated in FIGS. 11–16 further includes a battery tray for housing a conventional 6 volt lantern battery within the barricade itself. Sloping surface portion 76 of first sheet portion 60 includes a flap 96 cut or stamped therein. The flap includes a first flap scoreline 98 parallel to first scoreline 64 for allowing flap 96 to be folded away from sloping surface 76 and toward sloping surface 77 in a horizontal position when the barricade is erected. Second and third flap scorelines 100, and 102 are arranged perpendicular to first flap scoreline 98 and are folded in the same direction as is first flap scoreline 98. Thus, when the barricade is erected, second and third scorelines 100 and 102 border first and second vertical areas 104 and 106, respectively, of flap 96. The portion of flap 96 between second and third flap scorelines 100 and 102 corresponds .to a horizontal area 108 of flap 96.

Figure 16:
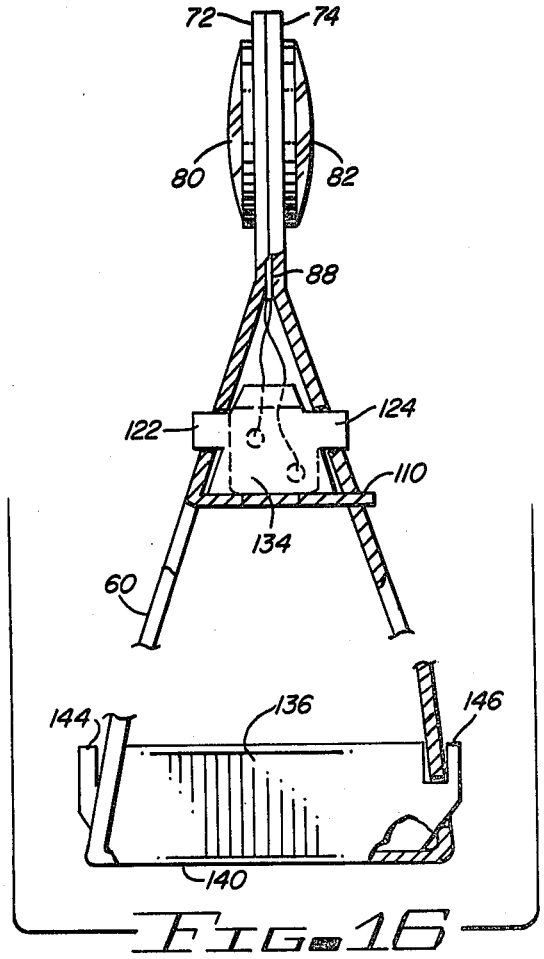
FIG. 16 is a partial cross-sectional view of the barricade of FIG. 11 illustrating the battery tray in assembled form.

Horizontal area 108 includes a tab 110 projecting from its edge opposite first flap scoreline 98. Sloping surface portion 77 of second sheet portion 62 includes a horizontally disposed slot 112 for engaging tab 110 and locking horizontal area 108 in a horizontal position, as shown in FIG. 16. Vertical area 104 includes a pair of tabs 114 and 116 which are engaged, respectively, by vertically disposed slots 118 and 120 within first sheet portion 60 and second sheet portion 62. Similarly, vertical area 106 includes tabs 122 and 124 which are engaged, respectively, by vertically disposed slots 126 and 128 within first sheet portion 60 and second sheet portion 62. Tabs 114, 116, 122 and 124, and slots 118, 120, 126, and 128, maintain vertical areas 104 and 106 of flap 96 in a vertical orientation to enclose the battery.

Vertical area 104 of flap 96 has metallic contacts 130 and 132 secured thereto for making electrical contact with the terminals of the battery supported within the described battery tray. As shown best in FIG. 16, battery 34 is inserted sideways into the battery tray formed by flap 96 whereby metallic contacts 130 and 132 contact the terminals of the battery when vertical area 104 is folded to an upright position. Metallic contacts 130 and 132 are coupled to wires 92 and 94, respectively, for supplying power to the warning light.

Thus, the battery which powers the warning light is entirely housed within the barricade constructed according to the teachings of the present invention. The battery is thereby protected from adverse weather conditions and is shielded from vehicles or other objects which may strike the barricade.

The barricade illustrated in FIG. 11 further includes a boxed base or tray to receive dirt or other ballast material to anchor the barricade in position. Referring to FIGS. 11, 12, 15 and 16, horizontal area 75 includes a pair of edge adjacent areas 136 and 138 which are foldable along scorelines 140 and 142, respectively, into an upright position. The outward corners of edge adjacent areas 136 and 138 include outwardly extending tabs 144, 146, 148 and 150. The sloping surface of first sheet portion 70 includes vertically disposed slots 152 and 154 for engaging tabs 144 and 148, respectively. Similarly, second sheet portion 62 includes vertically disposed slots 156 and 158 for engaging tabs 146 and 150, respectively. Tabs 144, 146, 148 and 150 and slots 152, 154, 156 and 158 maintain edge adjacent areas 136 and 138 in an upright position.

When assembled as described above, a tray is formed (best shown in FIGS. 11 and 16) having the horizontal area 75 on the bottom, having the sloping surfaces 76 and 77 of the flat sheet portion on each end, and having the edge adjacent areas 136 and 138 folded to an upright position on the sides. The tray thus formed provides a receptacle for receiving dirt or other ballast materials to anchor the barricade in place and permit it to withstand winds or other forces that would tend to dislodge the barricade from its designated position. It may be noted that the resulting anchored barricade has a very low center of gravity, thus presenting substantial stability and resistance to tipping. Furthermore, the construction of the boxed base or ballast tray prevents dirt or other loose ballast material from shifting or falling off of the barricade. Thus, the barricade remains anchored in place while the dirt or other loose ballast material is prevented from spilling onto freshly prepared surfaces adjacent the barricade. In addition, the construction of the boxed base adds rigidity and strength to the erected barricade. As shown in FIG. 11, the entire front surface of each vertical area and sloping surface of the first and second sheet portions can be printed or painted with warning strips. Application of such warning stripes to the entire visible area of the erected barricade increases overall visibility of the barricade. When white plastic corrugated material is used to construct a barricade according to the teachings of the present invention, the printing consists of orange stripes alternately printed on the white background. As shown in FIG. 14, stripes of adhesive-backed reflective material 163 matching the color, size, and position of the printed stripes, can be applied to portions of the barricade to increase night visibility.

When the barricade illustrated in FIG. 11 is to be stored for subsequent reuse, the battery tray and ballast tray tabs are removed from their respective slots and the battery is removed. The edge adjacent areas 136 and 138 are then flattened to a horizontal position, and base 75 is folded upwardly along scoreline 58, thereby allowing the barricade to be folded into a substantially flat compact structure.

Figure 17:
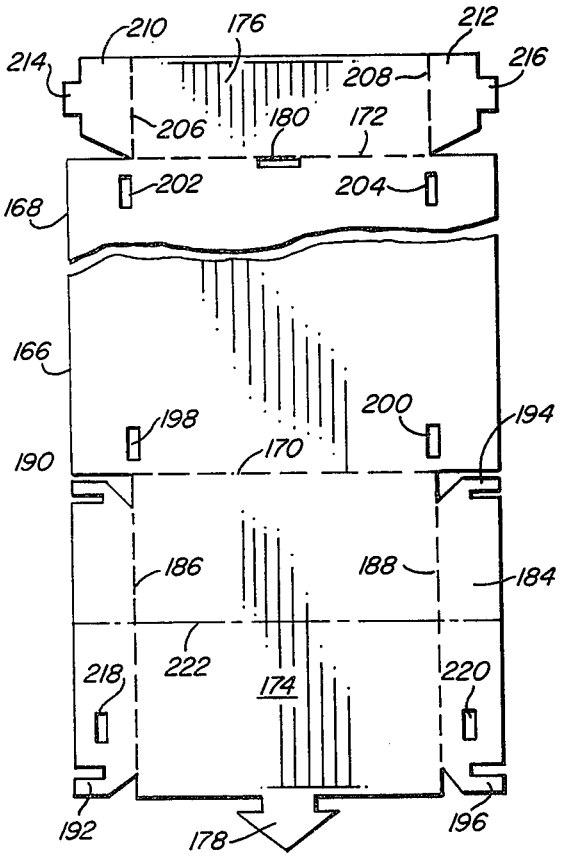
FIG. 17 is a partial top view of a flat sheet of foldable material formed so that it may be folded to form a barricade like that shown in FIG. 11.

In FIG. 17, another embodiment of the present invention is illustrated whereby a barricade of the type generally illustrated in FIG. 11 may be constructed from a single sheet of foldable material similar to that shown by FIG. 3. The single sheet of foldable material 164 shown in FIG. 17 includes a fold line (not shown) similar to fold line 17 shown in FIG. 3. The fold line divides single sheet 164 into a first sheet portion 166 and a second sheet portion 168. As in the single sheet of foldable material illustrated in FIG. 3, first and second sheet portions 166 and 168 each include a first scoreline (not shown) parallel to and equidistant from the fold line about which single sheet 164 is folded. The first scorelines again border vertical areas (not shown) when the barricade is erected as described above. First sheet portion 166 includes a second scoreline 170 for folding in a direction opposite to that of the first scoreline of first sheet portion 166. Similarly, second sheet portion 168 includes a second scoreline 172 for folding in a direction opposite to that of the first scoreline of second sheet portion 168. Second scoreline 170 borders a horizontal area 174 of first sheet portion 166. Similarly, second scoreline 172 borders a horizontal area 176 of second sheet portion 168. As in the barricade constructed from the single sheet portion of material illustrated in FIG. 3, first sheet 166 and second sheet portion 168 each has a sloping surface between its first and second scorelines when the barricade is erected.

In order to maintain second scorelines 170 and 172 in a predetermined spaced apart relationship when the barricade is erected, the edge of horizontal area 174 opposite second scoreline 170 includes a tab 178 for engaging a horizontally disposed slot 180 in the sloping surface of second sheet portion 168. Horizontal area 174 includes edge adjacent areas 182 and 184 which can be folded into an upright position along scorelines 186 and 188, respectively. Outwardly extending tabs 190, 192, 194 and 196 are provided at the outer corners of edge adjacent areas 182 and 184, as shown in FIG. 17. Vertically disposed slots 198 and 200 are provided within the sloping surface of first sheet portion 166 for engaging tabs 190 and 194, respectively, Similarly, verticaly disposed slots 202 and 204 are provided within the sloping surface of second sheet portion 168 for engaging tabs 192 and 196, respectively. Thus, a tray for containing dirt or other ballast material is again provided in the lower portion of the barricade.

Figure 18:
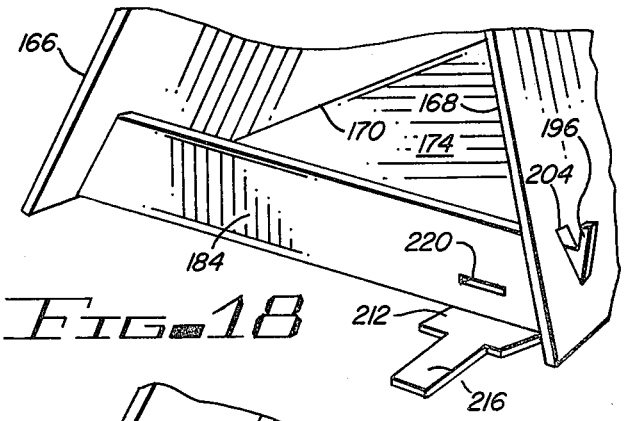
FIG. 18 is a partial perspective view of the foldable material of FIG. 17 shown in a partially folded condition wherein a foldable edge of a first horizontal area is secured in an upright position.
Figure 19:
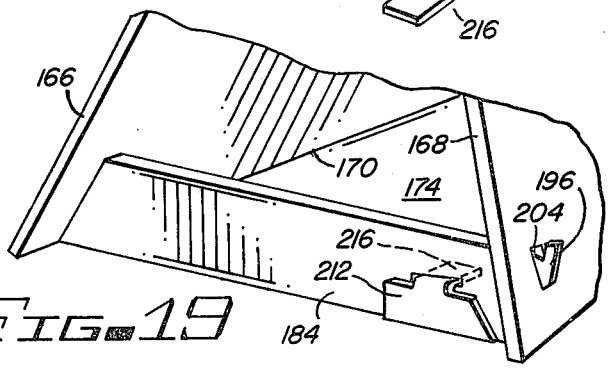
FIG. 19 is a view similar to FIG. 18 showing a locking tab of a second horizontal area engaged by a slot within the foldable edge of the first horizontal area.

As shown best in FIG. 18, horizontal area 176 of second sheet portion 168 underlaps horizontal area 174 of first sheet portion 166. Horizontal area 176 includes scorelines 206 and 208 which border tab portions 210 and 212, respectively, along opposite edges of horizontal area 176. As shown in FIG. 19, tab portions 210 and 212 are folded to an upright position adjacent to the edge adjacent areas 182 and 184, respectively, of horizontal area 174. Tabs 214 and 216 extending fro tab portions 210 and 212, respectively, are then inserted within horizontally disposed slots 218 and 220 within edge adjacent areas 182 and 184, respectively, to further interlock horizontal area 176 with horizontal area 174. Horizontal area 174 has a centrally disposed scoreline 222 parallel to second scoreline 170 to permit base 174 to be folded upwardly for storing the barricade as a relatively flat, compact unit.

A barricade constructed in accordance with the teachings of the present invention will therefore provide a very lightweight but nevertheless rugged barricade that is extremely compact . Further, the barricade will not damage vehicles that accidentally strike the barricade. This latter advantage is important in those instances where barricades may have been inadvertently misplaced and subsequently struck by an automobile, resulting in a dispute, and possible litigation, concerning damage to the automobile. The barricade of the present invention will cause minimal damage, and in most instances, no damage at all to such vehicles. In addition, the barricade of the present invention minimizes the possibility of injury to workmen handling such barricades; falling upon or being struck by such a barricade will result in little or no injury. No hinges or similar structures are presented that could possibly crush or injure a workman's hand when erecting, placing or removing the barricade of the present invention.

I claim:

1. A traffic barricade comprising:

a. a first flat sheet portion of foldable material having a first scoreline for folding in a first direction and a second scoreline for folding in a second direction, said first scoreline forming a border of a vertical area, said second scoreline forming a border of a horizontal area when said barricade is erected, said first flat sheet portion having a sloping surface between said first and second scorelines when said barricade is erected, the vertical area having a hole therein;

b. a first lens attached to a front side of the vertical area of said first flat sheet portion, said first lens being centrally disposed over the hole within the vertical area;

c. a second flat sheet portion of foldable material having a first scoreline for folding in a first direction and a second scoreline for folding in a second direction, said first scoreline forming a border of a vertical area, said second scoreline forming a border of a horizontal area when said barricade is erected, said second flat sheet portion having a sloping surface between said first and second scorelines when said barricade is erected, the vertical area having a hole therein;

d. a second lens attached to a front side of the vertical area of said second flat sheet portion, said second lens being centrally disposed over the hole within the vertical area;

e. means permanently securing the vertical areas of said first and second flat sheet portions in back-to-back contact with each other with the front sides thereof facing in opposite directions, the holes within the vertical areas of said first and second flat sheet portions being in alignment with each other;

f. means for maintaining said second scorelines of said first and second flat sheet portions in predetermined spaced apart relation when said barricade is erected; and g. lighting means disposed between said first and second lenses for simultaneously directing light through each of said first and second lenses.

2. A traffic barricade as recited in claim 1 wherein the sloping surface of said first flat sheet portion has a flap formed therein for providing a tray to support a battery, said flap having a flap scoreline parallel to said first scoreline of said first flat sheet portion for folding said flap away from the sloping surface of said first flat sheet portion and toward the sloping surface of said second flat sheet portion, said flap including securing means for securing an edge of said flap opposite said flap scoreline to the sloping surface of said second flat sheet portion.

3. A traffic barricade as recited in claim 2 wherein said securing means comprises a tab projecting from the edge of said flap opposite said flap scoreline, the sloping surface of said second flat sheet portion having a horizontally disposed slot for engaging said tab.

4. A traffic barricade as recited in claim 1 further including:

a. a flap formed within the sloping surface of said first flat sheet portion for providing a tray to support a battery, said flap having a first flap scoreline parallel to said first scoreline of said first flat sheet portion for folding said flap away from the sloping surface of said first flat sheet portion and toward the sloping surface of said second flat sheet portion, said flap also having second and third flap scorelines perpendicular to said first flap scoreline, said second and third flap scorelines bordering first and second vertical areas of said flap, said second and third flap scorelines defining a horizontal area of said flap therebetween, said second and third flap scorelines allowing each of the first and second vertical areas of said flap to be folded to an upright position;

b. first securing means for securing an edge of the horizontal area of said flap opposite said first flap scoreline to the sloping surface of said second flat sheet portion;

c. second securing means for securing the first vertical area of said flap to at least one of the sloping surfaces of said first and second flat sheet portions; and d. third securing means for securing the second vertical area of said flap to at least one of the sloping surfaces of said first and second flat sheet portions.

5. A traffic barricade as recited in claim 4 wherein said first securing means comprises a tab projecting from the edge of the horizontal area of said flap opposite said first flap scoreline, the sloping surface of said second flat sheet portion having a horizontally disposed slot for engaging said tab.

6. A traffic barricade as recited in claim 4 wherein said second and third securing means each comprises at least one tab projecting from an edge of the first and second vertical areas of said flap, respectively, said sloping surfaces of said first and second flat sheet portions including vertically disposed slots each engaging one of said tabs projecting from the edges of the first and second vertical areas of said flap.

7. A traffic barricade as recited in claim 4 further including metallic contacts secured to one of the vertical areas of said flap for contacting electrical terminals of a battery supported within the tray formed by said flap, and electrical wiring coupled between said metallic contacts and said lighting means for supplying power from said battery to said lighting means.

8. A traffic barricade as recited in claims 2, 4 or 7 wherein said lighting means is secured to the vertical area of said first flat sheet portion.

9. A traffic barricade as recited in claim 1 wherein said lighting means flashes on and off.

10. A traffic barricade as recited in claim 1 wherein said lenses are of plastic material.

11. A traffic barricade as recited in claims 9 or 10 wherein said lenses are amber in color.

12. A traffic barricade as recited by claim 1 wherein:

a. one of said horizontal areas extends between and in contact with the sloping surfaces of said first and second flat sheet portions to maintain said second scorelines in predetermined spaced apart relationship;

b. one of said horizontal areas including edge adjacent areas foldable to an upright position to form a tray having said horizontal area on bottom, having the sloping surfaces of said flat sheet portions on the ends, and having said edge adjacent areas folded to an upright position on the sides, thereby to provide a receptacle for receiving dirt or other ballast material to anchor said barricade against wind and other such forces; and c. each of said edge adjacent areas having an outwardly projecting tab at the outward corners thereof, said first and second flat sheet portions each including vertically disposed slots on the sloping surfaces thereof for engaging said outwardly projecting tabs of said edge adjacent areas for maintaining said edge adjacent areas in an upright position.

13. A traffic barricade as recited by claim 12 wherein both said horizontal area extending between the sloping surfaces of said first and second flat sheet portions and said horizontal area including edge adjacent areas are comprised by the horizontal area of said first flat sheet portion, the horizontal area of said second flat sheet portion underlapping the horizontal area of said first flat sheet portion and including tab portions at opposite edges thereof, said tab portions being foldable to an upright position adjacent said edge adjacent areas of the horizontal area of said first flat sheet portion, said tab portions including outwardly extending tabs, said edge adjacent areas of the horizontal area of said first flat sheet portion having slots formed therein for engaging said tabs extending from said tab portions of the horizontal area of said second flat sheet portion.

14. A traffic barricade as recited by claims 12 or 13 wherein said first and second flat sheet portions are formed from a single flat sheet of material folded along a line parallel to and equidistant from said first scorelines.

15. A traffic barricade as recited by claim 12 wherein said horizontal area including said edge adjacent areas has a scoreline parallel to and equidistant from said second scorelines of said first and second flat sheet portions for folding said traffic barricade into a compact structure when not in use.

16. A traffic barricade comprising:

a. a first flat sheet portion of foldable material having a first scoreline for folding in a first direction and a second scoreline for folding in a second direction, said first scoreline forming a border of a vertical area, said second scoreline forming a border of a horizontal area when said barricade is erected, said first flat sheet portion having a sloping surface between said first and second scorelines when said barricade is erected;

b. a second flat sheet portion of foldable material having a first scoreline for folding in a first direction and a second socreline for folding in a second direction, said first scoreline forming a border of a vertical area, said second scoreline forming a border of a horizontal area when said barricade is erected, said second flat sheet portion having a sloping surface between said first and second scorelines when said barricade is erected;

c. the vertical areas of said first and second flat sheet portions each having a front side;

d. means permanently securing the vertical areas of said first and second sheet portions in back-to-back contact with each other with the front sides thereof facing in opposite directions;

e. one of said horizontal areas extending between and in contact with the sloping surfaces of said first and second flat sheet portions to maintain said second scorelines in predetermined spaced apart relationship;

f. one of said horizontal areas including edge adjacent areas foldable to an upright position to form a tray having said horizontal area on the bottom, having the sloping surfaces of said flat sheet portions on the ends, and having said edge adjacent areas folded to an upright position on the sides, thereby to provide a receptacle for receiving dirt or other ballast material to anchor said barricade against wind and other such forces; and g. each of said edge adjacent areas having an outwardly projecting tab at the outward corners thereof, said first and second flat sheet portions each including vertically disposed slots on the sloping surfaces thereof for engaging said outwardly projecting tabs of said edge adjacent areas for maintaining said edge adjacent areas in an upright position.

17. A traffic barricade as recited in claim 16 wherein both said horizontal area extending between the sloping surfaces of said first and second flat sheet portions and said horizontal areas including edge adjacent areas are the horizontal area of said first flat sheet portion.

18. A traffic barricade as recited in claim 17 wherein the horizontal area of said second flat sheet portion underlaps the horizontal area of said first flat sheet portion.

19. A traffic barricade as recited in claim 18 wherein the horizontal area of said second flat sheet portion includes tab portions at opposite edges thereof, said tab portions being foldable to an upright position adjacent said edge adjacent areas of the horizontal area of said first flat sheet portion, said tab portions including outwardly extending tabs, said edge adjacent areas of the horizontal area of said first flat sheet portion having horizontally disposed slots for engaging said tabs extending from said tab portions of the horizontal area of said second flat sheet portion.

20. A traffic barricade as recited in claims 16, 17, 18 or 19 wherein said first and second flat sheet portions are formed from a single flat sheet of material folded along a line parallel to and equidistant from said first score lines.

21. A traffic barricade as recited in claim 16 wherein said first and second flat sheet portions are formed from a single flat sheet of material, the horizontal areas of said first and second flat sheet portions being a single cntinuous horizontal area formed from said single flat sheet of material.

22. A traffic barricade as recited in claim 16 wherein the entire surface of the vertical areas and sloping surfaces of the first and second flat sheet portions is printed with warning stripes.

23. A traffic barricade as recited in claim 22 wherein reflectorized material is applied to said first and second flat sheet portions.

24. A traffic barricade as recited in claim 16 wherein said horizontal area including said edge adjacent areas has a scoreline parallel to and equidistant from said second scorelines of said first and second flat sheet portions for folding said traffic barricade into a compact structure when not in use.

* * * * *